United States Patent [19]

Cameron

[11] Patent Number: 4,713,033

[45] Date of Patent: Dec. 15, 1987

[54] LINE THROW-BAG

[76] Inventor: Robert W. Cameron, 7724 115th Pl. NE., Kirkland, Wash. 98033

[21] Appl. No.: 841,957

[22] Filed: Mar. 19, 1986

[51] Int. Cl.[4] ..... B63C 9/26

[52] U.S. Cl. ..... 441/84; 383/3; 383/6; 383/72; 383/74; 383/121; 441/92; 441/95

[58] Field of Search ..... 441/28, 29, 88, 80, 441/81, 84, 85, 92, 93, 95, 97, 100, 101; 383/3, 6, 17, 18, 21, 72, 74, 75, 121

[56] References Cited

U.S. PATENT DOCUMENTS

| | | | |
|---|---|---|---|
| 2,701,886 | 2/1955 | Iuie | 441/95 |
| 3,674,188 | 7/1972 | Anderson | 383/18 X |
| 3,676,882 | 7/1972 | Lindquist | 441/85 |
| 3,977,448 | 8/1976 | Botting | 383/75 X |
| 4,143,796 | 3/1979 | Williamson et al. | 383/18 X |

FOREIGN PATENT DOCUMENTS

| | | | |
|---|---|---|---|
| 2506241 | 8/1976 | Fed. Rep. of Germany | 441/85 |
| 2301435 | 9/1976 | France | 441/85 |

*Primary Examiner*—Sherman D. Basinger
*Attorney, Agent, or Firm*—Seed and Berry

[57] ABSTRACT

A line throwing bag comprising a bag with a sidewall, an open end, a closed end formed by an end wall, and an interior compartment with sufficient size to loosely receive a plurality of folds of a central portion of a line. The line has a first end portion fixedly attached to the bag and extending through an aperture in the bag end wall with a loop positioned exterior of the bag for grasping by the person to be rescued. A looped second end portion extends through the bag open end and is positioned exterior of the bag for grasping by the person throwing the bag. A weight is fixedly attached to the bag end wall and weighs a sufficient amount to carry the bag forward when thrown for a distance substantially equal of the length of the line central portion and to gradually play the line out of the bag under the rearward drag created by holding the second line end portion stationary. A pair of looped straps have their ends fixedly attached to the bag end wall and have a handle portion and a pair of lengthwise extending portions slidably attached to the bag sidewall toward the bag open end. The looped straps can be pulled outward from the bag sidewall to form arm loops. In an alternative embodiment, a locking clip can be attached to the strap handle portions so that the straps can be extended around the person to be rescued and locked to provide a rescue harness.

49 Claims, 11 Drawing Figures

FIG. 1
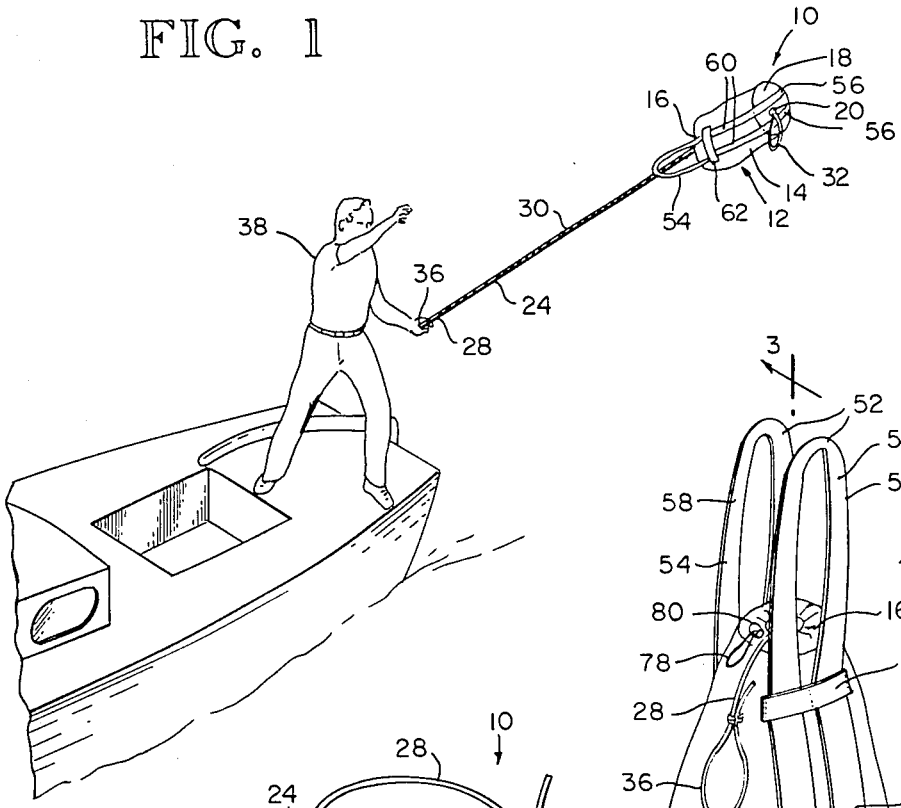
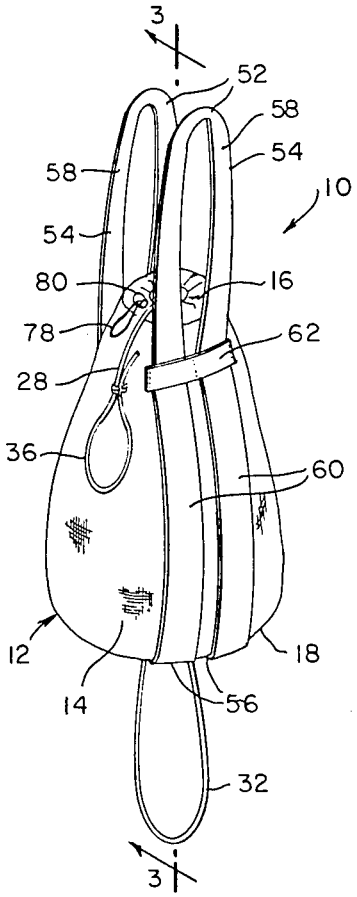
FIG. 2
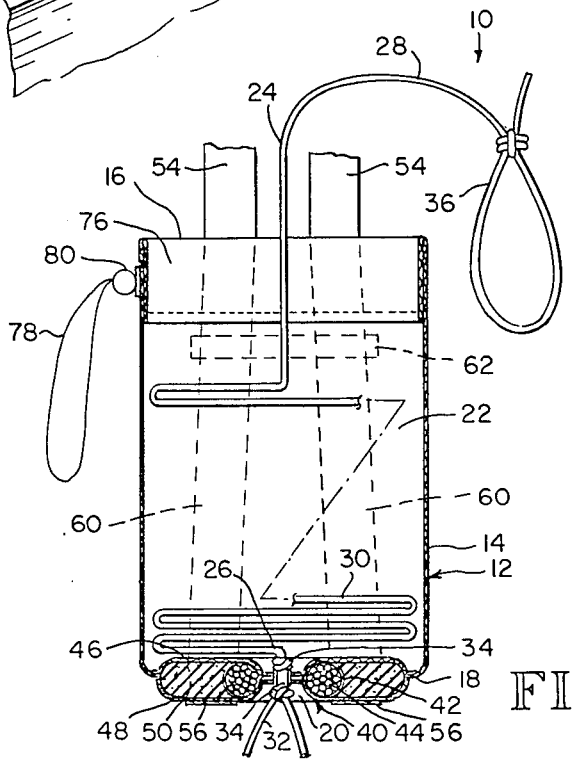
FIG. 3

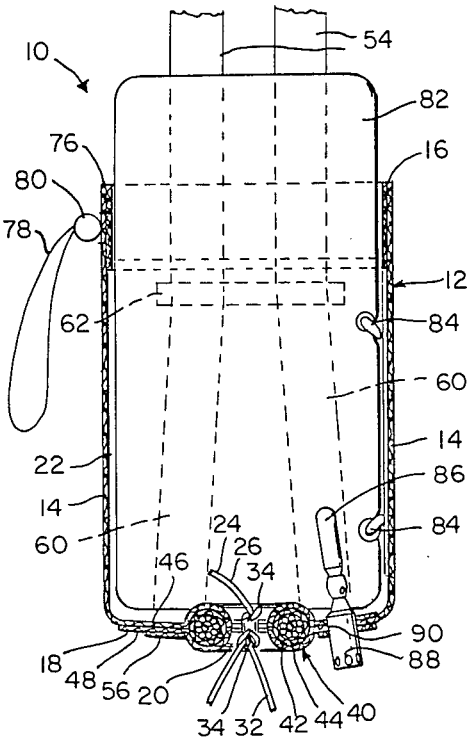
FIG. 4
FIG. 4A
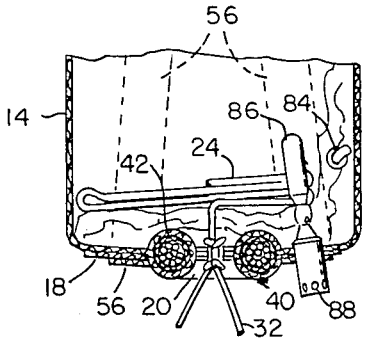
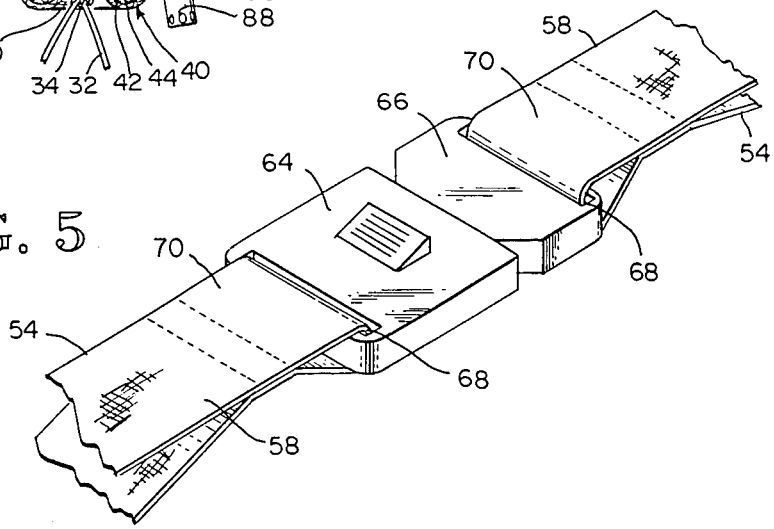
FIG. 5
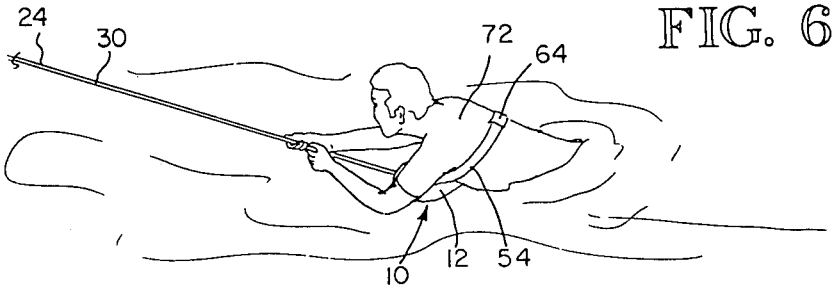
FIG. 6

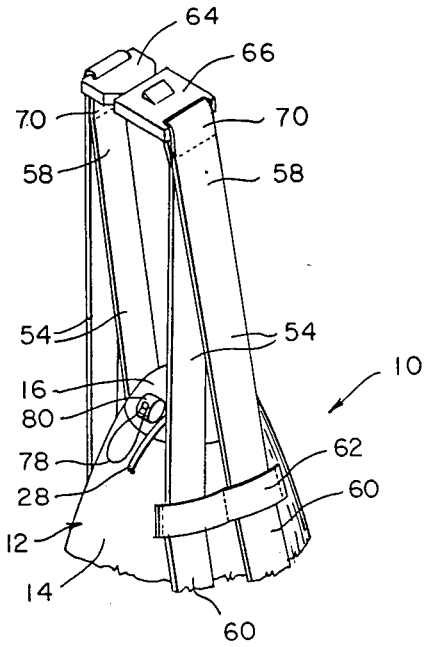
FIG. 4B
FIG. 7
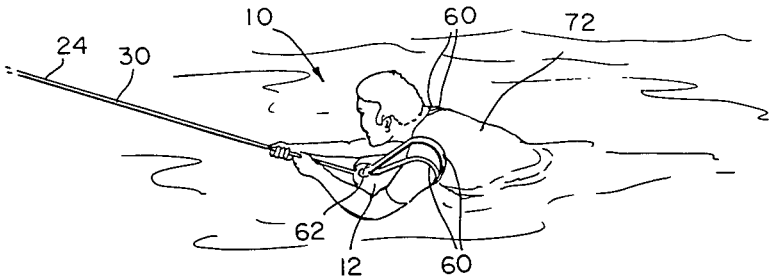
FIG. 8
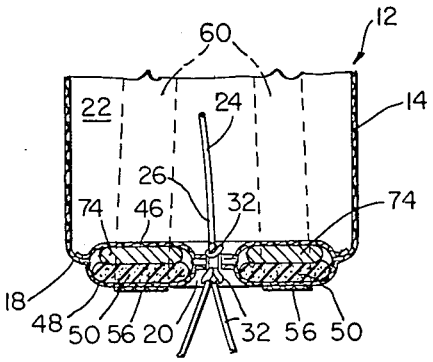
FIG. 9
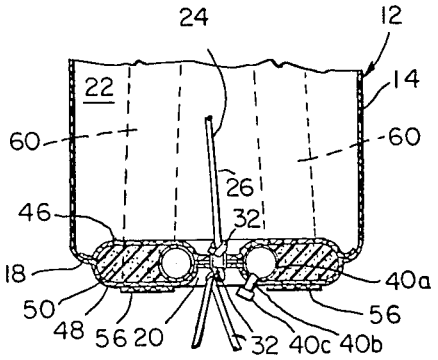

LINE THROW-BAG

DESCRIPTION

1. Technical Field

The present invention relates generally to heaving of lines, and more particularly to a line throw-bag.

2. Background of the Invention

When desiring to throw or heave a line or rope a substantial distance it is conventional to first coil the line, and then hold it in one hand with the free end grasped in the other hand. The entire coil is then thrown in the desired direction. Unfortunately, in situations where it is necessary to be extremely accurate with the throw, the results are many times less than satisfactory. A thrown coiled line has a tendency to twist and tangle. and the dynamics of the line flight makes it extremely difficult to accurately throw the coiled line a great distance. The coil tends to separate during its flight, and if a kink or tangle in the line develops, the free end of the line stops short of its intended target.

When the rope is used for rescue in water, it is extremely important that the first throw be accurate, since there is sometimes not time for a second throw. In other rescue situations, accuracy is also important. Of course, it is also important to be able to throw the line over a substantial distance, which has heretofore not been possible by merely throwing the coiled line.

In water rescue situation, merely throwing a line to a person to be rescued is not always adequate since once the line hits the water it can sink. Even if the line floats, it has little, if any; profile extending above the waterline so as to be visible to a person in the water. Additionally, hanging on to the loose end of a rope while it is being pulled in is difficult for a person in the water. If the water is extremely cold, the grasp of the person can quickly weaken to the point that he cannot hold on for the time it takes to reach safety. When a line is used in other types of rescue, such as where the person to be rescued must be raised at the end of the line, holding on to the free end of the rope, or even tying the rope into a loop and placing it around the person to be rescued, is not always possible.

It will therefore be appreciated that there is a significant need for a device which permits the accurate heaving of a line to a distant target and which allows the line to smoothly play out its entire length. Moreover, the device should provide the means for a person to be rescued from the water to see the line and facilitate his rescue. Means should be provided for situations in which the person to be rescue cannot simply hold onto the free end of the line. The present invention fulfills these needs, and further provides other related advantages.

DISCLOSURE OF THE INVENTION

The present invention resides in a line throw-bag including a bag with a sidewall, an open end, a closed end formed by an end wall, and an interior compartment. The interior compartment has sufficient size to loosely receive and store therein a length of line. The line has first and second end portions with a lengthy central portion therebetween. The first line end portion being fixedly attached to the bag and the central line portion be storable in a plurality of folds within the bag compartment. The second line end portion extends through the bag open end and is positioned exterior of the bag for grasping by the person throwing the bag. With the line throw-bag of the present invention, the line gradually plays out of the bag through the bag open end as the bag travels forward when thrown with the second line and portion being held stationary.

A weight is fixedly attached to the bag end wall and weighs a sufficient amount in combination with the weight of the bag to carry the bag forward when forwardly thrown for a distance substantially equal to the length of the line central portion. The weight carries the bag forward as the line gradually plays out of the bag under the rearward drag created by holding the second line end portion stationary. The weight is an annular weighted member having a central opening generally concentric with the end wall aperture.

The line throw-bag further includes a flotation member fixedly attached to the bag end wall and having sufficient buoyancy to keep the bag afloat in water in a generally upright position with the bag sidewall extending upward above the water level for visibility. In one embodiment the flotation member is an annular disc-shaped flotation member having a central opening generally concentric with the end wall aperture. In another embodiment, the line throw-bag utilizes a gas inflatable flotation bladder having sufficient buoyancy to not only keep the bag afloat, but assist in supporting the weight of the person to be rescued. In both embodiments, at least one handle is fixedly attached to the bag and is sized for releasable grasping by the person throwing the bag.

In a preferred embodiment of the invention used for water rescue, the bag is colored for high visibility and manufactured of a water resistant material. The bag sidewall is pliable and generally cylindrical in shape with sufficient stiffness to maintain an at least partially uncollapsed shape when under its own weight. The bag end wall has a central aperture through which the first line end portion extends. The first line end portion has a loop positioned exterior of the bag and sized for grasping by the person to be rescued. In addition, the first line end portion has a pair of knots, one of the knots being positioned to each side of the end wall aperture. The aperture is sized to prevent passage of the knots therethrough and firmly attaches the bag to the line.

The second line end portion extending through the bag open end has a looped positioned exterior of the bag and sized for grasping by the person throwing the bag.

In the disclosed embodiments, the line throw-bag includes a pair of handles fixedly attached to the bag and extendable beyond the bag open end. Each of the handles is attached to the bag sidewall at generally diametrically opposing positions. Each one of the pair of handles is a flexible strap with a handle portion positioned above the bag opening for grasping and with a lengthwise extending portion positioned exterior of the bag and fixedly attached to the bag at a location toward the bag closed end. The line throw-bag further includes a pair of retainers each fixedly attached to the bag sidewall at generally diametrically opposing positions toward the bag open end. Each of the retainers slidably retains one of the strap lengthwise portions.

Each of the strap lengthwise portions extends from its attachment location toward the bag closed end to its corresponding one of the retainers and has a sufficient length extending beyond the retainer that the lengthwise portion can be pulled outward from the bag sidewall at a point between its attachment location and its corresponding retainer to form an arm loop. The arm loop has an opening between the strap lengthwise portion and the bag sidewall sized sufficiently large for passage of an arm of the person to be rescued therethrough. As such, the handle portions of the straps are used to throw the bag, and after the bag is throw to the person to be rescued, the strap lengthwise portions can be pulled outward in opposite directions to form the arm loops for insertion of the arm of the person to be rescued therethrough to provide a rescue harness.

The line throw-bag may further include a quick release locable fastener having mating first and second separable locking members. Each of the handle portions of the flexible straps have one of the first and second members attached thereto. As such, the bag can be collapsed to effectively lengthen the available portion of the handle portions of the straps for wrapping the straps around the body of the person to be rescued. After around his body, the first and second members can be locked together to provide a secure rescue harness instead of utilizing the arm loops.

In the embodiment of the invention utilizing a bladder, the line throw-bag further includes a pressurized gas container in communication with the bladder and sized to hold sufficient gas to inflate the bladder. The gas container has a water activated valve to inflate the bladder automatically upon the water-activated valve being exposed to water. The bag end wall includes an aperture through which the water-activated valve extends to the exterior of the bag.

Other features and advantages of the invention will become apparent from the following detailed description taken in conjunction with the accompanying drawings.

DESCRIPTION OF THE DRAWINGS

FIG. 1 is an isometric view of a person throwing the line throw-bag of the present invention from the deck of a boat.

FIG. 2 is an enlarged, isometric view of the line throw-bag shown in FIG. 1.

FIG. 3 is an enlarged, fragmentary side elevational, sectional view of the line throw-bag of FIG. 1 showing the line in position within the bag in preparation for throwing of the bag.

FIG. 4 is an enlarged, fragmentary side elevational, sectional view of an alternative embodiment of the invention, utilizing an inflatable bladder showing the bladder inflated.

FIG. 4A is a fragmentary side elevational, sectional view of the bag of FIG. 4 showing the bladder deflated and folded in the bag.

FIG. 4B is a fragmentary, isometric view of the bag of FIG. 4 showing the upper bag portions with the clips of FIG. 5.

FIG. 5 is an isometric view of the releasable clips which are attached to the straps of the embodiment of the invention shown in FIG. 4.

FIG. 6 is an isometric view of a person being rescued from the water utilizing the line throw-bag shown in FIG. 4, with the straps wrapped around the person and the clips locked together to form a rescue harness.

FIG. 7 is an isometric view of a person being rescued utilizing the strap arm loops.

FIG. 8 is an enlarged, fragmentary side elevational sectional view of the line throw-bag shown in FIG. 1 utilizing an alternative shaped weight as the weighted member.

FIG. 9 is an enlarged, fragmentary side elevational, sectional view of the line throw-bag shown in FIG. 1 utilizing an alternative water filled bladder as the weighted member.

BEST MODE FOR CARRYING OUT THE INVENTION

As shown in the drawings for purposes of illustration, the present invention is embodied in a line throw-bag 10. In a preferred embodiment of the invention, the line throw-bag is utilized for water rescue, but in other embodiments, the line throw-bag may be used as a convenient method of deploying line in other rescue situations, or in any situation in which it is necessary to have a line over an extended distance with great accuracy.

The line throw-bag 10 used for water rescue includes a bag 12 colored for high visibility and manufactured from a water-resistant material. The bag has a pliable and generally cylindrical sidewall 14 with sufficient stiffness to maintain an at least partially uncollapsed shape under its own weight when empty. As such, the bag 12 tends to float when it lands upright in the water, and as will be described below, facilitates smooth playing out of the line in the bag.

The bag further has an open end 16, a closed end formed by an end wall 18 having a centrally located aperture 20 therethrough, and an interior compartment 22 with sufficient size to loosely receive and store therein a lenght of line 24. The line 24 has first and second end portions, 26 and 28, respectively, with a lengthy central portion 30 extending therebetween.

The first line end portion 26 extends through the end wall aperture 20 and has a loop 32 positioned exterior of the bag 12 and sized for grasping by the person to be rescued. The first line end portion 26 further has a pair of knots 34, one of the knots being positioned to each side of the end wall aperture 20. The end wall aperture 20 is sized to prevent passage of the knots therethrough under the pulling forces encountered during use of the line throw-bag 10 so as to provide a fixed attachment of the line 24 to the bag end wall 18.

The central line portion 30 is storable in a plurality of folds within the bag compartment 22. It is unnecessary to coil the line in the bag, and merely stuffing the line into the bag is sufficient. The second line end portion 28 extends through the bag open end 16 and has a loop 36 positioned exterior of the bag 12 and sized for grasping by the person 38 throwing the bag. With the line throw-bag 10 of the present invention, the line 24 gradually plays out of the bag through the bag open end 16 as the bag travels forward when thrown with the second line end portion loop 36 being held stationary. A floating line manufactured of polyproplyene monofilament fiber with a hollow core is utilized.

The embodiment of the line throw-bag shown in FIG. 3 includes an annular weighted member 40 comprising a doughnut-shaped sealed flexible bag 42 containing therewithin a quantity of loose ballast material 44 such as lead birdshot, sand or gravel. The ballast bag 42 is fixedly attached to the bag end wall 18 with the central opening generally concentric with the end wall aperture 20. In the embodiment of FIG. 3 the ballast bag is sewn within upper and lower fabric layers, 46 and 48, respectively, which form the bag end wall 18.

The weighted member 40 has sufficient weight in combination with the weight of the bag 12 to carry the bag forward when forwardly thrown for a distance substantially equal to the full length of the line central portion 30 within the bag compartment 22 and to gradually play the line out of the bag under the rearward drag created by holding the second line end portion loop 36 stationary while the line plays out. The weighted member 40 also has sufficient weight to cause the bag to land with the bag end wall 18 downward when thrown. Of course, the weight of the weighted member 40 must be selected to provide these characteristics but not so heavy as to be too difficult to lift or throw. A one pound weight has been found sufficient when using an eighty foot line.

The embodiment of the line throw-bag 10 shown in FIG. 3 includes an annular disc-shaped flotation member 50 manufactured of closed cool cell foam and positioned within the upper and lower layers 46 and 48 of the bag end wall 18, laterally outward of the ballast bag 42 with its central opening generally concentric with the end wall aperture 20. The flotation member 50 has sufficient buoyancy to keep the bag 12 including the weighted member 40, afloat in the water in a generally upright position with the bag sidewall 14 extending upward above the water level for visibility. Since the bag sidewall 14 has sufficient stiffness to maintain an at least partially uncollapsed shape, it facilitates a person in the water seeing the bag 12, and hence being able to locate the first line end portion loop 32, even in the presence of waves or chop.

A pair of handles 52 are also provided for the line throw-bag 10 and are fixedly attached to the bag 12. The handles 52 are extendable above the bag open end 16. The handles may be manufactured of a high visibility material such as a wide fabric strap. In the presently preferred embodiment of the invention, the bag sidewall 14 is colored international orange and the handles are a bright yellow color. The handles are sized for releasable grasping by the person 38 throwing the bag, and are attached to the bag at generally diametrically opposing positions on the bag sidewall 14 to provide a balanced support of the bag for accurate throwing. With the present invention the bag 12 can be thrown a great distance with accuracy, allowing utilization of the full length of the line 24 to accomplish rescues at the maximum distance possible for that length of line.

In the presently preferred embodiments of the invention, each of the two handles 52 is formed from a looped length of flexible fabric strap 54 with its two ends 56 fixedly attached to the bag end wall 18 at spaced apart locations. The looped straps 54 extend across the full width of the bag end wall. In the preferred embodiment, the looped straps 54 which form the two handle 52 are formed from a single long length of strap.

The looped straps 54 each have a handle portion 58 positionable above the bag open end 16 for grasping to throw the bag, and a pair of lengtwise extending portions 60 positioned exterior of the bag 12. The lengthwise portions 60 extend between the attachment location of the strap ends 56 and the handle portion 58. The line throw-bag 10 also has a pair of retainer straps 62 fixedly attached to the bag sidewall 14 at generally diametrically opposed positions toward the bag open end. Each retainer strap 62 forms two passageways which each slidably receive one of the strap lengthwise portion 60 forming one of the looped straps 54.

The strap lengthwise portions 60 each have sufficient length extending beyond the retainer strip 62 toward the handle portion 58 such that one or both of the lengthwise portions forming one of the looped straps 54 can be pulled outward from the bag sidewall 14 at a point between their attachment location at the bag end wall and their corresponding retainer strap 62 to form an arm loop. The arm loop provides an opening between the lengthwise portion 60 and the bag sidewall 14 sized sufficiently large for passage of an arm of the person to be rescued therethrough. As such, the handle portions 58 of the looped straps 54 are used to throw the bag 12, and after the bag is thrown to the person to be rescued, the strap lengthwise portions 60 can be pulled outward to form the arm loops for insertion of the arms of the person to be rescued therethrough to provide a rescue harness (see FIG. 7). The person can then wrap his arms tightly around the bag 12 to effectively improve his grasp of the line attached to the bag.

In the embodiment of the invention shown in FIGS. 4B and 5, a quick release lockable fastener clip is used having mating first and second separable locking members 64 and 66 respectively. Each of the handle portions 58 of the looped straps 54 have one of the first or second members 64 and 66 attached thereto. In the illustrated embodiment, the handle portion 58 of the looped strap 54 passes through an opening 68 in one of the locking members 64 or 66 and is sewed to form a loop 70 which retains the locking member in position. The bag 12 can be collapsed when received by the person to be rescued 72 and the retainer strap 62 slid along the lengthwise portion 60 of the looped strap to effectively lengthen the available portion of the looped strap for wrapping of the strap around the body of the person to be rescued (see FIG. 6). After the looped straps 54 are around the person to be rescued, the first and second members 64 and 66 can be locked together to provide a secure rescue harness instead of utilizing the arm loops described above. With this arrangement the line throw-bag 10 can be effectively used even if the person to be rescued is unconscious.

In the embodiment of the invention shown in FIG. 3, the disc-shaped flotation member 50 extends outward generally co-extensive with the bag end wall 18 and has sufficient rigidity to help maintain the bag sidewall 14 open and partially support the bag sidewall against fully collapsing inward. With this sidewall arrangement, the line 24 smoothly plays out of the bag compartment 22 when the bag 12 is thrown and the bag sidewall 14 maintains a high profile for visibility when the bag is floating upright in the water. In an alternative embodiment of the invention shown in FIG. 8, the weighted member 40 is a rigid disc or washer-shaped lead ballast weight 74. The ballast weight is in juxtaposition with the disc-shaped flotation member 50. In yet another alternative embodiment shown in FIG. 9 the weighted member 40 is a doughnut-shaped bladder 40*a* with a tube 40*b* and valve 40*c* which can be filled with water to produce the desired weight.

The bag 12 is further provided with a fold 76 at its open end 16 through which a looped drawstring 78 extends. The drawstring 78 is provided with a quick-release locking clip 80. The drawstring 78 and the locking clip 80 allow selective closing of the open end 16 of the bag. While the bag open end 16 is normally opened for throwing of the bag, it may be closed to maintain the central line portion 30 neatly within the bag during nonuse. When not being used, the handles 52 may be used to conveniently hang the bag on a hook for stowage of the bag and line. Since the central line portion 30 is maintained within the bag, it will not be subjected to knotting, kinking or tangles even if the line throw-bag 10 is dropped or carried about.

In an alternative embodiment of the invention shown in FIGS. 4 and 4A, the annular flotation member 50 is eliminated and a gas inflatable bladder 82 is provided within the bag compartment 22 for buoyancy. The bladder 82 when inflated substantially fills the bag interior compartment 22 and projects about six inches above bag open end 16 (see FIG. 4). The bladder 82 keeps the bag 12 afloat in the water and also assists in supporting the weight of the person in the water to whom the line throw-bag 10 is thrown for rescue. This is particularly useful in situations where the person to be rescued is tired or cannot maintain his head above water during the rescue, such as when unconscious. The bladder 82 is shown in FIG. 4A in the storage position, folded in the bag 12 against the bag end wall 18 with the line 24 folded on top.

The bladder 82 has an elongated shape, as does the bag compartment 22, and the bladder is positioned within the compartment so that upon inflation it extends longitudinally within the bag compartment upwardly from the bag end wall 18 to at or above the bag open end 16. The bladder 82 is removably attached to the bag sidewall 14 utilizing a pair of ties 84 which each extend through a grommet in a seam of the bladder and through a corresponding grommet in an interior seam of the bag's sidewall 14.

A pressurized gas container 86 is also positioned within the bag compartment and is in communication with the bladder 82. The gas container 86 is sized to hold sufficient gas, such as air, carbon dioxide or any other suitable gas to substantially fully inflate the bladder 82. In the presently preferred embodiment, the bladder 82 inflates about ten inches in diameter and the gas container 86 holds twenty-five grams of carbon dioxide. The gas container 86 has a conventional water-activated valve 88. The valve 88 extends outward through an off-centered aperture 90 in the bag end wall 18 to the exterior of the bag. With this arrangement, the bladder 82 will be inflated automatically by the gas container 86 upon the water activated valve 88 being exposed to water.

The bag 12 can further include a flotation member and a gas inflatable bladder.

In situations where it is desirable to accurately throw a line to a distant target other than water rescue, the flotation member 50 and bladder 82 may be eliminated. In certain situations the arm loops formed by the strap lengthwise portions 60 and the locking members 64 and 66 can be eliminated, and pouches can be sewn to the exterior bag sidewall 14 to hold items.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A line throw-bag for water rescue, comprising:

a bag colored for high visibility manufactured of a water resistant material, said bag having a pliable and generally cylindrical sidewall with sufficient stiffness to maintain an at least partially uncollapsed shape when under its own weight, said bag further having an open end, a closed end formed by an end wall with a central aperture, and an interior compartment with sufficient size to loosely receive and store therein a length of line, said line having first and second end portions with a lengthy central portion therebetween, said first line end portion extending through said end wall aperture and having a loop positioned exterior of said bag and sized for grasping by the person to be rescued, said first line end portion further having a pair of knots, one of said knots being positioned to each side of said end wall aperture and said end wall aperture being sized to prevent passage of said knots therethrough, said central line portion being storable in a plurality of folds within said bag compartment, said second line end portion extending through said bag open end and having a loop positioned exterior of said bag and sized for grasping by the person throwing said bag, whereby said line gradually plays out of said bag through said bag open end as said bag travels forward when thrown with said second line end portion loop being held stationary;

an annular weighted member fixedly attached to said bag end wall with a central opening generally concentric with said end wall aperture, said weighted member having sufficient weight in combination with the weight of said bag to carry said bag forward when forwardly thrown for a distance substantially equal to the length of said line central portion and to gradually play said line out of said bag under the rearward drag created by holding said second line end portion loop stationary while said line plays out, said weighted member having sufficient weight to cause said bag to land with said bag end wall downward when thrown;

an annular disc-shaped flotation member fixedly attached to said bag end wall and having a central opening generally concentric with said end wall aperture, said flotation member having sufficient buoyancy to keep said bag afloat in water in a generally upright position with said bag sidewall extending upward above the water level for visibility; and a pair of handles fixedly attached to said bag and extendable beyond said bag open end, said handles being sized for releasable grasping by the person throwing said bag, each of said handles being attached to said bag sidewall at generally diametrically opposing positions.

2. The line throw-bag of claim 1 wherein each one of said pair of handles is a flexible strap with a looped handle portion positionable above said bag open end for grasping to throw said bag, said strap having a lengthwise extending portion positioned exterior of said bag and fixedly attached to said bag at a location toward said bag closed end, and wherein the line throw-bag further includes a pair of retainers, each fixedly attached to said bag sidewall at generally diametrically opposing positions toward said bag open end and slidably retaining one of said strap lengthwise portions, each of said strap lengthwise portions extending from its attachment location toward said bag closed end to its corresponding one of said retainers and having sufficient length extending beyond said retainer that said lengthwise portion can be pulled outward from said bag sidewall at a point between its attachment location and its corresponding retainer to form an arm loop, said arm loop having an opening between said strap lengthwise portion and said bag sidewall sized sufficiently large for passage of an arm of the person to be rescued therethrough, whereby said handle portions of said straps are used to throw said bag, and after said bag is thrown to the person to be rescued, said strap lengthwise portions can be pulled outward to form said arm loops for insertion of the arms of the person to be rescued therethrough to provide a rescue harness.

3. The line throw-bag of claim 2 further including a quick release lockable fastener having mating first and second separable locking members, each of said handle portions of said flexible straps having one of said first or second members attached thereto, whereby said bag can be collapsed to effectively lengthen the available portion of said straps for wrapping said straps around the body of the person to be rescued, and after around his body said first and second members can be locked together to provide a secure rescue harness instead of utilizing said arm loops.

4. The line throw-bag of claim 1 wherein each of said pair of handles is a flexible strap with a handle portion positionable above said bag open end for grasping to throw said bag, said strap having a lengthwise extending portion positioned exterior of said bag, the line throw-bag further including a quick release lockable fastener having mating first and second separable locking members, one of said first and second members being attached to each of said handle portions, and further including a pair of retainers, each fixedly attached to said sidewall at generally diametrically opposing positions toward said bag open end and slidably retaining one of said strap lengthwise portions, each of said strap lengthwise portions extending from its attachment location toward said bag closed end beyond its corresponding one of said retainers to said strap handle portion, said lengthwise portion having sufficient length extending beyond said retainer to permit collapsing of said bag sidewall to effectively lengthen the available portion of said strap for wrapping around the body of the person to be rescued, whereby after rescue, said first and second members can be locked together around the body to provide a secure rescue harness.

5. The line throw-bag of claim 1 wherein each one of said pair of handles includes a looped length of flexible strap having its two ends fixedly attached to said bag toward said bag closed end at spaced apart locations.

6. The line throw-bag of claim 5 wherein said looped straps extend at least partially across said bag end wall and have their ends fixedly attached to said end wall.

7. The line throw-bag of claim 5 wherein said looped straps each have a handle portion positionable above said bag open end for grasping to throw said bag, and a pair of lengthwise extending portions positioned exterior of said bag extending between the attachment location of said strap ends and said handle portion, and wherein the line throw-bag further includes retainers, at least one of said retainers being fixedly attached to said bag sidewall at generally diametrically opposed positions toward said bag open end and slidably retaining both of said strap lengthwise portions of a corresponding one of said looped straps, said strap lengthwise portions extending from their attachment location toward said bag closed end to their corresponding one of said retainers and having sufficient length extending beyond said retainer that both of said strap lengthwise portions forming one of said looped straps can be pulled outward from said bag sidewall at a point between their attachment location and their corresponding retainer to form an arm loop, said arm loop having an opening between said strap lengthwise portions and said bag sidewall sized sufficiently large for passage of an arm of the person to be rescued therethrough, whereby said handle portions of said looped straps are used to throw said bag, and after said bag is thrown to the person to be rescued, said strap lengthwise portions can be pulled outward to form said arm loops for insertion of the arms of the person to be rescued therethrough to provide a rescue harness.

8. The line throw-bag of claim 7, further including a quick release lockable fastener having mating first and second separable locking members, each of said handle portions of said looped straps having one of said first or second members attached thereto, whereby said bag can be collapsed to effectively lengthen the available portion of said looped straps for wrapping said straps around the body of the person to be rescued, and after around his body said first and second members can be locked together to provide a secure rescue harness instead of utilizing said arm loops.

9. The line throw-bag of claim 5 wherein said looped strap each have a handle portion positionable above said bag open end for grasping to throw said bag, and a pair of lengthwise extending portions positioned exterior of said bag, the line throw-bag furhter including a quick release lockable fastener having mating first and second separable locking members, one of said first or second members being attached to each of said handle portions, and further including a pair of retainers, each fixedly attached to said bag sidewall at generally diametrically opposing positions toward said bag open end and slidably retaining both of said strap lengthwise portions of a corresponding one of said looped straps, said strap lengthwise portions extending from their attachment location toward said bag closed end beyond its corresponding one of said retainers to said strap handle portion, said lengthwise portions having sufficient length extending beyond said retainer to permit collapsing of said bag sidewall to effectively lengthen the available portion of said looped strap for wrapping around the body of the person to be rescued, whereby after rescue, said first and second members can be locked together around the body to provide a secure rescue harness.

10. The line throw-bag of claim 1 wherein said disc-shaped flotation member extends outward generally coextensive with said bag end wall and has sufficient rigidity to partially support said bag sidewalls against fully collapsing inward, whereby said line smoothly plays out of said bag compartment when said bag is thrown and said bag sidewalls maintain a higher profile for visibility when said bag is floating upright in the water.

11. The line throw-bag of claim 1 wherein said weighted member includes a sealed flexible bag containing therewithin a desired quantity of loose ballast material, said ballast bag being fixedly attached to said bag end wall.

12. The line throw-bag of claim 1 wherein said weighted member is a rigid disc-shaped ballast weight, said ballast weight being in juxtaposition with said disc-shaped flotation member.

13. The line throw-bag of claim 1 wherein said bag further includes a releasable draw string at said bag open end for selectively closing said open end.

14. A line throw-bag for water rescue, comprising:

a bag having a pliable sidewall with sufficient stiffness to maintain an at least partially uncollapsed shape when under its own weight, said bag further having an open end, a closed end formed by an end wall, and an interior compartment with sufficient size to loosely receive and store therein a length of line, said line having first and second end portions with a lengthy central portion therebetween, said first line end portion being fixedly attached to said end wall, said central line portion being storable in a plurality of folds within said bag compartment, said second line end portion extending through said bag open end and positioned exterior of said bag for grasping by the person throwing said bag, whereby said line gradually plays out of said bag through said bag open end as said bag travels forward when thrown with said second line end portion being held stationary;

a weight fixedly attached to said bag end wall and weighing a sufficient amount in combination with the weight of said bag to carry said bag forward when forwardly thrown for a distance substantially equal to the length of said line central portion and to gradually play said line out of said bag under the rearward drag created by holding said second line end portion stationary while said line plays out, said weight further having sufficient weight to cause said bag to land with said bag end wall downward when thrown;

a flotation member fixedly attached to said bag end wall and having sufficient buoyancy to keep said bag afloat in water in a generally upright position with said bag sidewall extending upward above the water level for visibility; and a pair of handles fixedly attached to said bag and extendable beyond said bag open end, said handles being sized for releasable grasping by the person throwing said bag, each one of said pair of handles being attached to said bag sidewall at generally opposite positions and being a flexible strap with a handle portion positionable above said bag open end for grasping to throw said bag, said strap having a lengthwise extending portion positioned exterior of said bag and fixedly attached to said bag at a location toward said bag closed end, and wherein the line throw-bag further includes a pair of retainers, each fixedly attached to said bag sidewall at generally opposing positions toward said bag open end and slidably retaining one of said strap lengthwise portions, each of said strap lengthwise portions extending from its attachment location toward said bag closed end to its corresponding one of said retainers and having sufficient length extending beyond said retainer and having lengthwise portion can be pulled outward from said bag sidewall at a point between its attachment location and its corresponding retainer to form an arm loop, said arm loop having an opening between said strap lengthwise portion and said bag sidewall sized sufficiently large for passage of an arm of the person to be rescued therethrough.

15. The line throw-bag of claim 14, further including means fixedly attached to said body end wall exterior of said bag for grasping by the person to be rescued.

16. A line throw-bag for water rescue, comprising:

a bag having a pliable sidewall with sufficient stiffness to maintain an at least partially uncollapsed shape when under its own weight, said bag further having an open end, a closed end formed by an end wall, and an interior compartment with sufficient size to loosely receive and store therein a length of line, said line having first and second end portions with a lengthy central portion therebetween, said first line end portion being fixedly attached to said end wall, said central line portion being storable in a plurality of folds within said bag compartment, said second line end portion extending through said bag open end and positioned exterior of said bag for grasping by the person throwing said bag, whereby said line gradually plays out of said bag through said bag open end as said bag travels forward when thrown with said second line end portion being held stationary;

a weight fixedly attached to said bag end wall and weighing a sufficient amount in combination with the weight of said bag to carry said bag forward when forwardly thrown for a distance substantially equal to the length of said line central portion and to gradually play said line out of said bag under the rearward drage created by holding said second line end portion stationary while said line plays out, said weight further having sufficient weight to cause said bag to land with said bag end wall downward when thrown;

a flotation member fixedly attached to said bag end wall and having sufficient buoyancy to keep said bag afloat in water in a generally upright position with said bag sidewall extending upward above the water level for visibility; and a pair of handles fixedly attached to said bag and extendable beyond said bag open end, said handles being sized for releasable grasping by the person throwing said bag, said handles including a pair of flexible straps each with a handle portion positionable above said bag open end for grasping to throw said bag, said strap having a lengthwise extending portion positioned exterior of said bag, the line throw-bag further including a quick release lockable fastener having mating first and second separable locking members, one of said first or second members being attached to each of said handle portions, and further including a pair of retainers, each fixedly attached to said bag sidewall at generally diametrically opposing positions toward said bag open end and slidably retaining one of said strap lengthwise portions, each of said strap lengthwise portions extending from its attachment location toward said bag closed end beyond its corresponding one of said retainers to said strap handle portion, said lengthwise portion having sufficient length extending beyond said retainer to permit collapsing of said bag sidewall to effectively lengthen the available portion of said strap for wrapping around the body of the person to be rescued, whereby after rescue, said first and second members can be locked together around the body to provide a secure rescue harness.

17. A line throw-bag for rescue, comprising:

a bag having a pliable sidewall, said bag further having an open end, a closed end formed by an end wall, and an interior compartment with sufficient size to loosely receive and store therein a length of line, said line having first and second end portions with a lengthy central portion therebetween, said first line end portion being fixedly attached to said bag, said central line portion being storable in a plurality of folds within said bag compartment, said second line end portion extendable through said bag open end and positionable exterior of said bag for grasping by the person throwing said bag, whereby said line gradually plays out of said bag through said bag open end as said bag travels forward when thrown with said second line end portion being held stationary;

a weight fixedly attached to said bag and weighing a sufficient amount in combination with the weight of said bag to carry said bag forward when forwardly thrown for a distance substantially equal to the length of said line central portion and to gradually play said line out of said bag under the rearward drag created by holding said second line end portion stationary while said line plays out;

a pair of looped lengths of flexible straps, each looped strap having its two ends fixedly attached to said bag toward said bag closed end at spaced apart locations, said looped straps each having a handle portion positionable above said bag open end and sized for releasable grasping by the person throwing the bag, and a pair of lengthwise extending portions extending between the attachment location of said strap ends and said handle portion; and a pair of retainers, at least one of said retainers being fixedly attached to said bag sidewall at generally opposed positions toward said bag open end and slidably retaining both of said strap lengthwise portions of a corresponding one of said looped straps, said strap lengthwise portions extending from their attachment location toward said bag closed end to their corresponding one of said retainers and having sufficient length extending beyond said retainer that both of said strap lengthwise portions forming one of said looped straps can be pulled outward from said bag sidewall at a point between their attachment location and their corresponding retainer to form an arm loop, said arm loop having an opening between said strap lengthwise portions and said bag sidewall sized sufficiently large for passage of an arm of the person to be rescued therethrough, whereby said handle portions of said looped straps are used to throw said bag, and after said bag is thrown to the person to be rescued, said strap lengthwise portions can be pulled outward to form said arm loops for insertion of the arms of the person to be rescued therethrough to provide a rescue harness.

18. The line throw-bag of claim 17 wherein said looped straps extend at least partially across said bag end wall and have their ends fixedly attached to said end wall.

19. A line throw-bag for rescue, comprising:

a bag having a pliable sidewall, said bag further having an open end, a closed end formed by an end wall, and an interior compartment with sufficient size to loosely receive and store therein a length of line, said line having first and second end portions with a lengthy central portion therebetween, said first line end portion being fixedly attached to said bag, said central line portion being storable in a plurality of folds within said bag compartment, said second line end portion extendable through said bag open end and positionable exterior of said bag for grasping by the person throwing said bag, whereby said line gradually plays out of said bag through said bag open end as said bag travels forward when thrown with said second line end portion being held stationary;

a weight fixedly attached to said bag and weighing a sufficient amount in combination with the weight of said bag to carry said bag forward when forwardly thrown for a distance substantially equal to the length of said line central portion and to gradually play said line out of said bag under the rearward drag created by holding said second line end portion stationary while said line plays out;

a pair of looped lengths of flexible straps, each looped strap having its two ends fixedly attached to said bag toward said bag closed end at spaced apart locations, said looped strap each having a handle portion positionable above said bag open end and sized for releasable grasping by the person throwing the bag, and a pair of lengthwise extending portions;

a quick release lockable fastener having mating first and second separable locking members, one of said first or second members being attached to each of said handle portions; and a pair of retainers, each fixedly attached to said bag sidewall at generally diametrically opposing positions toward said bag open end and slidably retaining both of said strap lengthwise portions of a corresponding one of said looped straps, said strap lengthwise portions extending from their attachment location toward said bag closed end beyond its corresponding one of said retainers to said strap handle portion, said lengthwise portions having sufficient length extending beyond said retainer to permit collapsing of said bag sidewall to effectively lengthen the available portion of said looped strap for wrapping around the body of the person to be rescued, whereby after rescue, said first and second members can be locked together around the body to provide a secure rescue harness.

20. The line throw-bag of claim 14 wherein said flotation member has a generally disc-shape extending outward generally coextensive with said bag end wall and has sufficient rigidity to partially support said bag sidewalls against fully collapsing inward, whereby said line smoothly plays out of said bag compartment when said bag is thrown and said bag sidewalls maintain a higher profile for visibility when said bag is floating upright in the water.

21. The line throw-bag of claim 14 wherein said weight includes a water tight bladder selectively fillable with water to achieve the desired weight for said weight.

22. The line throw-bag of claim 14 wherein said weight includes a sealed flexible bag containing therewithin a desired quantity of loose ballast material, said ballast bag being fixedly attached to said bag end wall.

23. The line throw-bag of claim 14 wherein said weight is a rigid disc-shaped ballast weight, said ballast weight being in juxtaposition with said disc-shaped flotation member.

24. The line throw-bag of claim 14 wherein said bag further includes a releasable draw string at said bag open end for selectively closing said open end.

25. A line throw-bag, comprising:

a bag having a sidewall, an open end, a closed end formed by an end wall, and an interior compartment with sufficient size to loosely receive and store therein a length of line, said line having first and second end portions with a lengthy central portion therebetween, said first line end portion being fixedly attached to said bag, said central line portion being storable in a plurality of folds within said bag compartment, said second line end portion extending through said bag open end and positioned exterior of said bag for grasping by the person throwing said bag, whereby said line gradually plays out of said bag through said bag open end as said bag travels forward when thrown with said second line end portion being held stationary;

a weight fixedly attached to said bag end wall and weighing a sufficient amount in combination with the weight of said bag to carry said bag forward when forwardly thrown for a distance substantially equal to the length of said line central portion and to gradually play said line out of said bag under the rearward drag created by holding said second line end portion stationary;

a flotation member attached to said bag having sufficient buoyancy to keep said bag afloat in water;

a gas inflatable bladder attached to said bag having sufficient buoyancy when inflated to keep said bag afloat in water and to assist in supporting the weight of another person floating in the water to whom the line throw-bag is thrown; and at least one handle fixedly attached to said bag and sized for releasable grasping by the person throwing said bag.

26. The line throw-bag of claim 25, further including means fixedly attached to said bag for grasping by another person to whom the line throw-bag is thrown.

27. The line throw-bag of claim 25 wherein said at least one handle includes a pair of handles, being a flexible strap with a handle portion positionable above said bag open end for grasping to throw said bag.

28. The line throw-bag of claim 25 further including a pressurized gas container in communication with said bladder and sized to hold sufficient gas to inflate said bladder.

29. The line throw-bag of claim 28 wherein said gas container has a water activated valve, whereby said bladder will be inflated automatically by said gas container upon said water activated valve being exposed to water.

30. The line throw-bag of claim 29 wherein said bladder and said gas cylinder are positioned within said bag compartment, and said bag end wall includes an aperture through which said water activated valve extends to the exterior of said bag.

31. A line throw-bag for water rescue, comprising:

a bag colored for high visibility manufactured of a water resistant material, said bag having a pliable sidewall with sufficient stiffness to maintain an at least partially uncollapsed shape when under its own weight, said bag further having an open end, a closed end formed by an end wall with a central aperture, and an interior compartment with sufficient size to loosely receive and store therein a length of line, said line having first and second end portions with a lengthy central portion therebetween, said first line end portion extending through said end wall aperture and having a loop positioned exterior of said bag and sized for grasping by the person to be rescued, said first line end portion further having a pair of knots, one of said knots being positioned to each side of said end wall aperture and said end wall aperture being sized to prevent passage of said knots therethrough, said central line portion being storable in a plurality of folds within said bag compartment, said second line end portion extending through said bag open end and having a loop positioned exterior of said bag and sized for grasping by the person throwing said bag, whereby said line gradually plays out of said bag through said bag open end as said bag travels forward when thrown with said second line end portion loop being held stationary;

an annular weighted member fixedly attached to said bag end wall with a central opening generally concentric with said end wall aperture, said weighted member having sufficient weight in combination with the weight of said bag to carry said bag forward for a distance substantially equal to the length of said line central portion and to gradually play said line out of said bag when forwardly thrown for a distance substantially equal to the length of said line central portion and to gradually play said line out of said bag under the rearward drag created by holding said second line end portion loop stationary while said line plays out, said weighted member having sufficient weight to cause said bag to land with said bag end wall downward when thrown;

a gas inflatable flotation bladder positioned within said bag compartment and attached to said bag, said flotation bladder when inflated substantially filling said bag compartment and having sufficient buoyancy to keep said bag afloat in water in a generally upright position with said bag sidewall extending upward above the water level for visibility and to assist in supporting the weight of the person to be rescued; and a pair of handles fixedly attached to said bag and extendable beyond said bag open end, said handles being sized for releasable grasping by the person throwing said bag, each of said handles being attached to said bag sidewall at generally opposing positions.

32. The line throw-bag of claim 31 further including a pressurized gas container in communication with said bladder and sized to hold sufficient gas to inflate said bladder.

33. The line throw-bag of claim 32 wherein said gas container has a water activated valve, whereby said bladder will be inflated automatically by said gas container upon said water activated valve being exposed to water.

34. The line throw-bag of claim 32 wherein said bag end wall includes an aperture through which said water activated valve extends to the exterior of said bag.

35. The line throw-bag of claim 31 wherein said bladder has an elongated shape and is positioned in said bag to lengthwise extend upwardly from said bag end wall upon inflation.

36. The line throw-bag of claim 31 wherein said bag has an elongated bag compartment, and said bladder has an elongated shape and is positioned and upon inflation extends longitudinally within said bag compartment.

37. The line throw-bag of claim 36 wherein said bladder has a lengthwise extending wall which is removably attached to said bag sidewall.

38. The line throw-bag of claim 31 wherein each one of said pair of handles is a flexible strap with a handle portion positionable above said bag open end for grasping to throw said bag, said strap having a lengthwise extending portion positioned exterior of said bag and fixedly attached to said bag at a location toward said bag closed end, and wherein the line throw-bag further includes a pair of retainers, each fixedly attached to said bag sidewall at generally opposing positions toward said bag open end and slidably retaining one of said strap lengthwise portions, each of said strap lengthwise portions extending from its attachment location toward said bag closed end to its corresponding one of said retainers and having sufficient length extending beyond said retainer that said lengthwise portion can be pulled outward from said bag sidewall at a point between its attachment location and its corresponding retainer to form an arm loop, said arm loop having an opening between said strap lengthwise portion and said bag sidewall sized sufficiently large for passage of an arm of the person to be rescued therethrough, whereby said handle portions of said straps are used to throw said bag, and after said bag is thrown to the person to be rescued, said strap lengthwise portions can be pulled outward to form said arm loops for insertion of the arms of the person to be rescued therethrough to provide a rescue harness.

39. The line throw-bag of claim 38 further including a quick release lockable fastener having mating first and second separable locking members, each of said handle portions of said flexible straps having one of said first or second members attached thereto, whereby said bag can be collapsed to effectively lengthen the available portion of said straps for wrapping said straps around the body of the person to be rescued, and after around his body said first and second members can be locked together to provide a secure rescue harness instead of utilizing said arm loops.

40. The line throw-bag of claim 31 wherein each of said pair of handles is a flexible strap with a handle portion positionable above said bag open end for grasping to throw said bag, said strap having a lengthwise extending portion positioned exterior of said bag, the line throw-bag further including a quick release lockable fastener having mating first and second separable locking members, one of said first or second members being attached to each of said handle portions, and further including a pair of retainers, each fixedly attached to said bag sidewall at generally diametrically opposing positions toward said bag open end and slidably retaining one of said strap lengthwise portions, each of said strap lengthwise portions extending from its attachment location toward said bag closed end beyond its corresponding one of said retainers to said strap handle portion, said lengthwise portion having sufficient length extending beyond said retainer to permit collapsing of said bag sidewall to effectively lengthen the available portion of said strap for wrapping around the body of the person to be rescued, whereby after rescue, said first and second members can be locked together around the body to provide a secure rescue harness.

41. A line throw-bag for water rescue, comprising:

a bag having a sidewall, an open end, a closed end formed by an end wall, and an interior compartment with sufficient size to loosely receive and stored therein a length of line, said line having first and second end portions with a lengthy central portion therebetween, said first line end portion being fixedly attached to said end wall, said central line portion being storable in a plurality of folds within said bag compartment, said second line end portion extending through said bag open end and positioned exterior of said bag for grasping by the person throwing said bag, whereby said line gradually plays out of said bag through said bag open end as said bag travels forward when thrown with said second line end portion being held stationary;

a weight fixedly attached to said bag end wall and weighing a sufficient amount in combination with the weight of said bag to carry said bag forward when forwardly thrown for a distance substantially equal to the length of said line central portion and to gradually play said line out of said bag under the rearward drag created by holding said second line end portion stationary while said line plays out, said weight further having sufficient weight to cause said bag to land with said bag end wall downward when thrown;

a gas inflatable flotation bladder attached to said bag and having sufficient buoyancy to keep said bag afloat in water and to assist in supporting the weight of the person to be rescued; and a pair of handles fixedly attached to said bag and extendable beyond said bag open end, said handles being sized for releasable grasping by the person throwing said bag, each one of said pair of handles being attached to said bag sidewall at generally opposite positions and being a flexible strap with a handle portion positionable above said bag open end for grasping to throw said bag, said strap having a lengthwise extending portion positioned exterior of said bag and fixedly attached to said bag at a location toward said bag closed end, and wherein the line throw-bag further includes a pair of retainers, each fixedly attached to said bag sidewall at generally opposing positions toward said bag open end and slidably retaining one of said strap lengthwise portions, each of said strap lengthwise portions extending from its attachment location toward said bag closed end to its corresponding one of said retainers and having sufficient lengthwise portion can be pulled outward from said bag sidewall at a point between its attachment location and its corresponding retainer to form an arm loop, said arm loop having an opening between said strap lengthwise portion and said bag sidewall sized sufficiently large for passage of an arm of the person to be rescued therethrough.

42. The line throw-bag of claim 41, further including means fixedly attached to said body end wall exterior of said bag for grasping by the person to be rescued.

43. The line throw-bag of claim 41 further including a pressurized gas container in communication with said bladder and sized to hold sufficient gas to inflate said bladder.

44. The line throw-bag of claim 43 wherein said gas container has a water activated valve, whereby said bladder will be inflated automatically by said gas container upon said water activated valve being exposed to water.

45. The line throw-bag of claim 43 wherein said bag end wall includes an aperture through which said water activated valve extends to the exterior of said bag.

46. The line throw-bag of claim 41 wherein said bladder has an elongated shaped and is positioned in said bag to lengthwise extend upwardly from said bag end wall upon inflation.

47. The line throw-bag of claim 41 wherein said bag has an elongated bag compartment, and said bladder has an elongated shape, said bladder being positioned to extend longitudinally within said bag compartment upon inflation and is attached to said bag sidewall to hold said sidewall extending upward above the waterline for visibility upon inflation.

48. The line throw-bag of claim 47 wherein said bladder has a lengthwise extending wall and is removably attached to said bag sidewall.

49. A line throw-bag for water rescue, comprising:

a bag having a sidewall, an open end, a closed end formed by an end wall, and an interior compartment with sufficient size to loosely receive and store therein a length of line, said line having first and second end portions with a lengthy central portion therebetween, said first line end portion being fixedly attached to said end wall, said central line portion being storable in a plurality of folds within said bag compartment, said second line end portion extending through said bag open end and positioned exterior of said bag for grasping by the person throwing said bag, whereby said line gradually plays out of said bag through said bag open end as said bag travels forward when thrown with said second line end portion being held stationary;

a weight fixedly attached to said bag end wall and weighing a sufficient amount in combination with the weight of said bag to carry said bag forward when forwardly thrown for a distance substantially equal to the length of said line central portion and to gradually play said line out of said bag under the rearward drag created by holding said second line end portion stationary while said line plays out, said weight further having sufficient weight to cause said bag to land with said bag end wall downward when thrown;

a gas inflatable flotation bladder attached to said bag and having sufficient buoyancy to keep said bag afloat in water and to assist in supporting the weight of the person to be rescued; and a pair of handles fixedly attached to said bag and extendable beyond said bag open end, said handles being sized for releasable grasping by the person throwing said bag, said handles including a pair of flexible straps each with a handle portion positionable above said bag open end for grasping to throw said bag, said strap having a lengthwise extending portion positioned exterior of said bag, the line throw-bag further including a quick release lockable fastener having mating first and second separable locking members, one of said first or second members being attached to each of said handle portions, and further including a pair of retainers, each fixedly attached to said bag sidewall at generally diametrically opposing positions toward said bag open end and slidably retaining one of said strap lengthwise portions, each of said strap lengthwise portions extending from its attachment location toward said bag closed end beyond its corresponding one of said retainers to said strap handle portion, said lengthwise portion having sufficient length extending beyond said retainer to permit collapsing of said bag sidewall to effectively lengthen the available portion of said strap for wrapping around the body of the person to be rescued, whereby after rescue, said first and second members can be locked together around the body to provide a secure rescue harness.

* * * * *

UNITED STATES PATENT AND TRADEMARK OFFICE

CERTIFICATE OF CORRECTION

PATENT NO. : 4,713,033

DATED : December 15, 1987

INVENTOR(S) : Robert W. Cameron

It is certified that error appears in the above-identified patent and that said Letters Patent is hereby corrected as shown below:

In the Claims:

Claim 9, column 10, line 18, delete the word "strap" and substitute therefor --straps--.

Claim 14, column 11, line 47, delete the words "and having" and substitute therefor --that said--.

Claim 16, column 12, line 15, delete the word "drage" and substitute therefor --drag--.

Claim 41, column 17, line 57, delete the word "stored" and substitute therefor --store--.

Claim 46, column 18, line 59, delete the word "shaped" and substitute therefor --shape--.

Signed and Sealed this

Seventeenth Day of May, 1988

*Attest:*

*Attesting Officer*

DONALD J. QUIGG

*Commissioner of Patents and Trademarks*